US010408221B2

(12) United States Patent
Byon

(10) Patent No.: US 10,408,221 B2
(45) Date of Patent: Sep. 10, 2019

(54) TURBOCHARGER

(71) Applicant: IHI Corporation, Koto-ku (JP)

(72) Inventor: Jinhee Byon, Tokyo (JP)

(73) Assignee: IHI Corporation, Koto-ku (JP)

( * ) Notice: Subject to any disclaimer, the term of this patent is extended or adjusted under 35 U.S.C. 154(b) by 389 days.

(21) Appl. No.: 15/269,068

(22) Filed: Sep. 19, 2016

(65) Prior Publication Data

US 2017/0002826 A1 Jan. 5, 2017

Related U.S. Application Data

(63) Continuation of application No. PCT/JP2015/063288, filed on May 8, 2015.

(30) Foreign Application Priority Data

May 16, 2014 (JP) ..... 2014-102739

(51) Int. Cl.
*F04D 29/16* (2006.01)
*F04D 29/10* (2006.01)
(Continued)

(52) U.S. Cl.
CPC ..... *F04D 29/102* (2013.01); *F01D 5/02* (2013.01); *F01D 5/048* (2013.01); *F01D 11/005* (2013.01);
(Continued)

(58) Field of Classification Search
CPC ..... F04D 29/102; F04D 29/162; F04D 29/12; F04D 29/441
See application file for complete search history.

(56) References Cited

U.S. PATENT DOCUMENTS 5,297,928 A 3/1994 Imakiire et al.
6,168,375 B1 1/2001 Larue et al.
7,509,804 B2 * 3/2009 Kobayashi ..... F01D 17/165 415/158

FOREIGN PATENT DOCUMENTS

CN 1321225 A 11/2001
JP 2002-180841 6/2002
(Continued)

OTHER PUBLICATIONS

Combined Chinese Office Action and Search Report dated Jan. 26, 2018 in Patent Application No. 201580014816.2 (with English language translation of categories of cited documents).
(Continued)

*Primary Examiner* — Woody A Lee, Jr.
*Assistant Examiner* — Sabbir Hasan
(74) *Attorney, Agent, or Firm* — Oblon, McClelland, Maier & Neustadt, L.L.P.

(57) ABSTRACT

A turbocharger includes: an annular diffuser flow passage formed by two opposed surfaces of a compressor housing and a bearing housing; and a seal plate located inside of the diffuser flow passage in a radial direction, and disposed to be opposed to a back surface of a compressor wheel. A gap in the radial direction is formed between a radially inside end of the opposed surface of the bearing housing that forms the diffuser flow passage and an outer peripheral edge of the compressor wheel. The seal plate has a larger diameter than that of the compressor wheel. A protrusion, which extends more to the compressor housing side than does a region opposed to a back surface of the compressor wheel, is provided in a region of the seal plate facing the gap.

5 Claims, 5 Drawing Sheets

(51) Int. Cl.

| | |
|---|---|
| ***F02B 39/00*** | (2006.01) |
| ***F01D 5/02*** | (2006.01) |
| ***F01D 11/00*** | (2006.01) |
| ***F01D 25/16*** | (2006.01) |
| ***F04D 29/053*** | (2006.01) |
| ***F04D 29/056*** | (2006.01) |
| ***F04D 29/28*** | (2006.01) |
| ***F04D 29/42*** | (2006.01) |
| ***F04D 29/44*** | (2006.01) |
| ***F01D 5/04*** | (2006.01) |

(52) U.S. Cl.
CPC ..... *F01D 25/166* (2013.01); *F02B 39/00* (2013.01); *F04D 29/053* (2013.01); *F04D 29/056* (2013.01); *F04D 29/162* (2013.01); *F04D 29/284* (2013.01); *F04D 29/4206* (2013.01); *F04D 29/441* (2013.01); *F05D 2220/40* (2013.01)

(56) References Cited

FOREIGN PATENT DOCUMENTS

| | | |
|---|---|---|
| JP | 2003-526037 | 9/2003 |
| JP | 2005-76463 | 3/2005 |
| JP | 2012-67614 | 4/2012 |
| JP | 2013-76365 | 4/2013 |
| JP | 2013-221454 | 10/2013 |
| WO | WO 2013/124614 A1 | 8/2013 |

OTHER PUBLICATIONS

International Search report dated Jul. 28, 2015 in PCT/JP2015/063288, filed May 8, 2015 ( with English Translation).
Written Opinion dated Jul. 28, 2015 in PCT/JP2015/063288, filed May 8, 2015.
Office Action dated Dec. 12, 2017 in Japanese Patent Application No. 2016-519230.

* cited by examiner

TURBOCHARGER

CROSS REFERENCE TO RELATED APPLICATIONS

This application is a continuation application of International Application No. PCT/JP2015/063288, filed on May 8, 2015, which claims priority to Japanese Patent Application No. 2014-102739, filed on May 16, 2014, the entire contents of which are incorporated by reference herein.

BACKGROUND

1. Technical Field

The present disclosure relates to a turbocharger including a seal plate which is provided opposed to a back surface side of a compressor wheel.

2. Description of the Related Art

There has heretofore been known a turbocharger in which a shaft provided with a turbine wheel on one end and a compressor wheel on the other end is rotatably supported by a bearing provided in a bearing housing. The turbocharger thus configured is connected to an engine, then the turbine wheel is rotated by exhaust gas discharged from the engine and the compressor wheel is rotated through the shaft by the rotation of the turbine wheel. Thus, the turbocharger compresses air along with the rotation of the compressor wheel and sends the compressed air out to the engine.

In a turbocharger shown in Japanese Patent Application Laid-Open Publication No. 2005-76463, for example, a seal plate opposed to a compressor wheel is provided on a back surface side of the compressor wheel (i.e., on a side facing a bearing housing when viewed from the compressor wheel). The seal plate is fitted and fixed into a hole formed in a bearing housing, and prevents lubricant oil having lubricated a bearing from leaking out of the bearing housing to the compressor wheel side. Moreover, a diffuser flow passage is formed on outside in a radial direction of the seal plate. The diffuser flow passage is formed annularly by using mutually opposed surfaces of the bearing housing and a compressor housing, the surfaces being provided with a space in between. Air is compressed by the compressor wheel and then flows in the diffuser flow passage outward in the radial direction.

SUMMARY

In the meantime, there is a case where an outside diameter of the seal plate is designed to be larger than an outside diameter of the compressor wheel with reduction in size of the compressor wheel. In this case, a radially inside end portion of the opposed surface of the bearing housing, which forms the diffuser flow passage and is opposed to the compressor housing, i.e., an edge of the hole into which the seal plate is to be fitted, is located outside of an outer peripheral edge of the compressor wheel in the radial direction. In addition, a gap in the radial direction is formed between a wall surface of the diffuser flow passage (the bearing housing) and the compressor wheel. This gap grows larger as the compressor wheel becomes smaller in size. As a consequence, an air flow is apt to stagnate at the gap portion, which may contribute to turbulence of the air flow to the diffuser flow passage side.

An object of the present disclosure is to provide a turbocharger, which is capable of suppressing turbulence of a flow of a fluid from a compressor wheel toward a diffuser flow passage, and thereby improving compression efficiency.

An aspect of the present disclosure is a turbocharger including: a bearing housing provided with a bearing hole; a turbine shaft including a shaft rotatably supported by a bearing to be housed in the bearing hole, a turbine wheel provided on one end side of the shaft, and a compressor wheel provided on another end side of the shaft; a compressor housing connected to the bearing housing and configured to house the compressor wheel in a housing space formed in the compressor housing; a diffuser flow passage of an annular shape located outside of the compressor wheel in a radial direction, and formed by two opposed surfaces of the compressor housing and the bearing housing being opposed to each other; and a seal plate attached to the bearing housing, located inside of the diffuser flow passage in the radial direction, and disposed to be opposed to a back surface of the compressor wheel. A gap in the radial direction is formed between a radially inside end of the opposed surface of the bearing housing forming the diffuser flow passage and an outer peripheral edge of the compressor wheel, and the seal plate has a diameter larger than a diameter of the compressor wheel, and a region of the seal plate facing the gap is provided with an extending portion extending more to the compressor housing side than any region of the seal plate opposed to back surface of the compressor wheel.

Of the extending portion, a surface opposed to the compressor housing may be an inclined surface that comes closer to the compressor housing as the inclined surface extends outward in the radial direction.

A tapered surface may be provided in a region of the bearing housing, the region forming an end portion on the inside in the radial direction of the diffuser flow passage, the tapered surface being inclined in such an orientation that the tapered surface comes closer to the bearing side as the tapered surface extends inward in the radial direction, and the inclined surface may extend on an extended line of the tapered surface.

An end portion on the inside in the radial direction of the inclined surface may be located closer to the bearing side than a region of a wall surface of the bearing housing forming the diffuser flow passage, the region being continuous from the tapered surface to the outside in the radial direction.

According to the present disclosure, it is possible to suppress turbulence of a flow of a fluid from a compressor wheel toward a diffuser flow passage, and thereby to improve compression efficiency.

BRIEF DESCRIPTION OF THE DRAWINGS

FIG. 3A and FIG. 3B are explanatory diagrams for explaining an action of a protrusion, in which FIG. 3A is an enlarged diagram of a portion indicated with a chain dashed line in FIG. 1, and FIG. 3B shows a comparative example thereto.

DESCRIPTION OF THE EMBODIMENTS

An embodiment of the present disclosure will be described below in detail with reference to the accompanying drawings. It is to be noted that dimensions, materials, other specific numerical values, and the like shown in the embodiment are mere examples for facilitating understanding of the disclosure and are not intended to limit the scope of the present disclosure unless otherwise specifically stated. Moreover, in the specification and the drawings, elements having substantially the same functions and/or configurations are denoted by the same reference signs and overlapping explanation will thus be omitted. Furthermore, illustration of elements not directly related to the present disclosure will be omitted.

Figure 1:
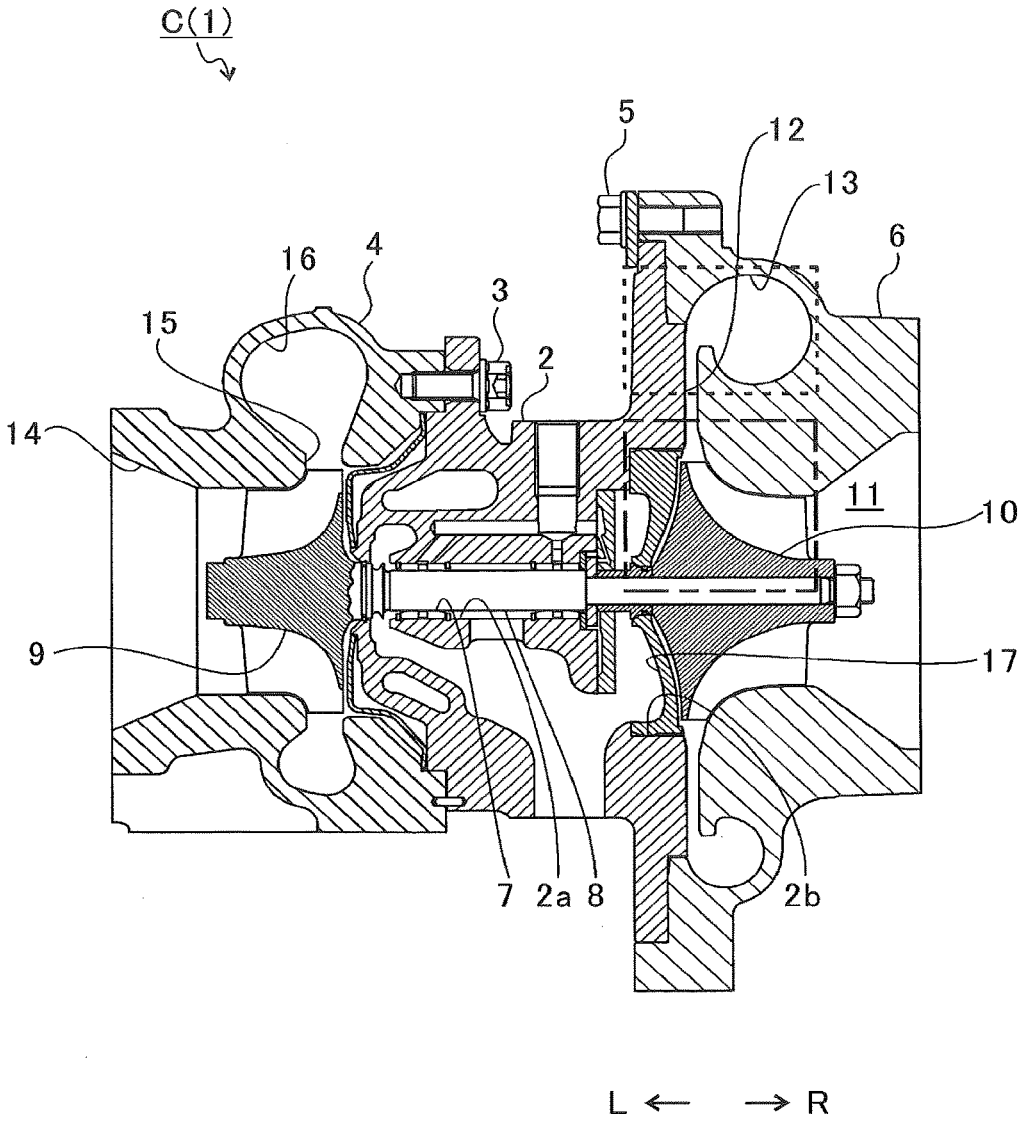
FIG. 1 is a schematic cross-sectional view of a turbocharger according to an embodiment of the present disclosure.

FIG. 1 is a schematic cross-sectional view of a turbocharger C according to the embodiment. The following description will be given on the premise that an arrow L shown in FIG. 1 is a direction indicating a left side of the turbocharger C while an arrow R shown therein is a direction indicating a right side of the turbocharger C. As shown in FIG. 1, the turbocharger C includes a turbocharger body 1. The turbocharger body 1 includes a bearing housing 2, a turbine housing 4 connected to the left side of the bearing housing 2 by using a fastening bolt 3, and a compressor housing 6 connected to the right side of the bearing housing 2 by using a fastening bolt 5, all of which are integrated together.

The bearing housing 2 is provided with a bearing hole 2*a* that penetrates the bearing housing 2 in a right-left direction of the turbocharger C. A bearing 7 is housed in the bearing hole 2*a*, and rotatably supports a shaft 8. A turbine wheel 9 is integrally fixed to a left end portion of the shaft 8. The turbine wheel 9 is rotatably housed in a housing space in the turbine housing 4. In the meantime, a compressor wheel 10 is integrally fixed to a right end portion of the shaft 8. The compressor housing 6 is provided with a housing space 11. The housing space 11 is opened to the right side of the turbocharger C. Meanwhile, the housing space 11 is connected to an air cleaner (not shown). The compressor wheel 10 is rotatably housed in the housing space 11. Note that a turbine shaft is formed at least from the shaft 8, the turbine wheel 9, and the compressor wheel 10.

Meanwhile, the bearing housing 2 and the compressor housing 6 include surfaces 2*d* and 6*a* which are opposed to each other in the state where the bearing housing 2 is connected to the compressor housing 6 by the fastening bolt 5. The surfaces 2*d* and 6*a* will be hereinafter referred to as opposed surfaces 2*d* and 6*a* for the convenience of description. The opposed surfaces 2*d* and 6*a* are located away from each other in the right-left direction in the state where the bearing housing 2 is connected to the compressor housing 6. Accordingly, the opposed surfaces 2*d* and 6*a* form a diffuser flow passage 12 located outside of the compressor wheel 10 in the radial direction. The diffuser flow passage 12 boosts air (a fluid) having passed through the compressor wheel 10. The diffuser flow passage 12 is formed annularly from inside to outside in the radial direction of the shaft 8, and is connected to the housing space 11 through the compressor wheel 10 on the inside in the radial direction mentioned above.

Moreover, the compressor housing 6 is provided with a compressor scroll flow passage 13. The compressor scroll flow passage 13 is formed annularly and is located outside of the diffuser flow passage 12 in the radial direction of the shaft 8. The compressor scroll flow passage 13 is connected to an intake port of an engine (not shown). Moreover, the compressor scroll flow passage 13 is also connected to the diffuser flow passage 12. As a consequence, when the compressor wheel 10 is rotated, the air is suctioned into the housing space 11 inside the compressor housing 6, then is accelerated by the action of a centrifugal force in the process of a flow through spaces between vanes of the compressor wheel 10, then flows in the diffuser flow passage 12 from the inside to the outside in the radial direction, and is further boosted and guided to the intake port of the engine while flowing in the compressor scroll flow passage 13.

The turbine housing 4 is provided with a discharge port 14. The discharge port 14 is opened to the left side of the turbocharger C and is connected to an exhaust emission control system (not shown). Moreover, the turbine housing 4 is provided with a flow passage 15, and an annular turbine scroll flow passage 16 located outside of the flow passage 15 in the radial direction of the shaft 8 (the turbine wheel 9).

The turbine scroll flow passage 16 is connected to a gas inflow port (not shown) to which exhaust gas discharged from an exhaust manifold of the engine (not shown) is guided. The turbine scroll flow passage 16 is also connected to the above-mentioned flow passage 15_ As a consequence, the exhaust gas from the engine is guided from the gas inflow port (not shown) to the turbine scroll flow passage 16, and is then guided to the discharge port 14 through the flow passage 15 and the turbine wheel 9. The exhaust gas rotates the turbine wheel 9 in this flow process. Then, a rotative force of the turbine wheel 9 is transmitted to the compressor wheel 10 through the shaft 8. As mentioned previously, the air is boosted and guided to the intake port of the engine by the rotative force of the compressor wheel 10 generated by the transmission.

Meanwhile, a seal plate 17 is provided on a back surface side of the compressor wheel 10 (on the left side in FIG. 1, or on a side facing the bearing housing 2 when viewed from the compressor wheel 10).

Figure 2A:
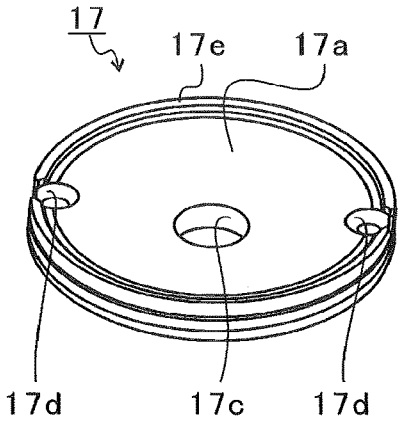
FIG. 2A to FIG. 2D are perspective views of a seal plate.
Figure 2B:
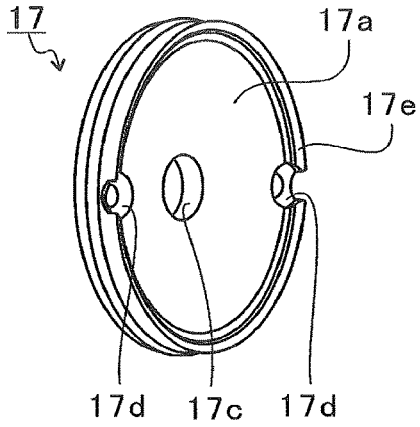
Figure 2C:
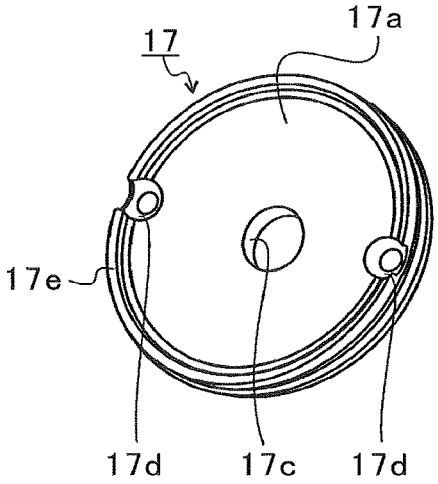
Figure 2D:
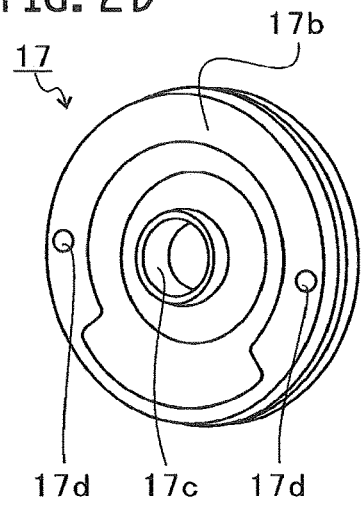

FIG. 2A to FIG. 2D are perspective views of the seal plate 17. Specifically, FIG. 2A to FIG. 2C are perspective views mainly illustrating a front surface 17*a* on the compressor wheel 10 side of the seal plate 17. FIG. 2D is a perspective view mainly illustrating a back surface 17*b* on the bearing 7 side of the seal plate 17.

As shown in FIG. 2A to FIG. 2C, the seal plate 17 is a substantially disc-shaped member having a larger size than the compressor wheel 10 when viewed in the right-left direction. In other words, the seal plate 17 has a larger diameter than that of the compressor wheel 10. An insertion hole 17*c*, into which the shaft 8 is to be inserted, is provided at the center in the radial direction of the seal plate 17. Moreover, two bolt holes 17*d* are provided on an outer side in the radial direction of the seal plate 17, and penetrate the seal plate 17 in the same direction as an extending direction of the insertion hole 17*c*. A fastening bolt (not shown) is inserted into each bolt hole 17*d*.

As shown in FIG. 1, a fitting hole 2*b* is formed in a surface on the compressor wheel 10 side of the bearing housing 2. The fitting hole 2*b* is recessed from this surface to the bearing 7 side. The seal plate 17 is fitted into the fitting hole 2*b*. Screw holes (not shown) are formed in a bottom surface of the fitting hole 2*b*. The screw holes (not shown) are formed at such positions to be opposed to the bolt holes 17*d* of the seal plate 17 when the seal plate 17 is fitted in, and are brought into threaded engagement with the fastening bolts inserted into the bolt holes 17*d*. In other words, the seal plate 17 is fitted into the fitting hole 2*b* and is fixed (attached) to the bearing housing 2 by using the fastening bolts (not shown). The fastening bolts are countersunk bolts, for example.

The seal plate 17 is in close contact with bearing housing 2 so as to prevent lubricant oil having lubricated the bearing 7 housed in the bearing housing 2 from leaking out to the compressor housing 6 side.

Moreover, as shown in FIG. 2A to FIG. 2C, the seal plate 17 has the front surface 17*a* located on the compressor wheel 10 side. A protrusion 17*e* (an extending portion) is formed on the front surface 17*a*. The protrusion 17*e* is provided on an outer edge of the front surface 17*a* located on the outer side in the radial direction. Specifically, the protrusion 17*e* is formed along a circumferential direction of the seal plate 17 except portions overlapping the bolt holes 17*d*.

Figure 3A:
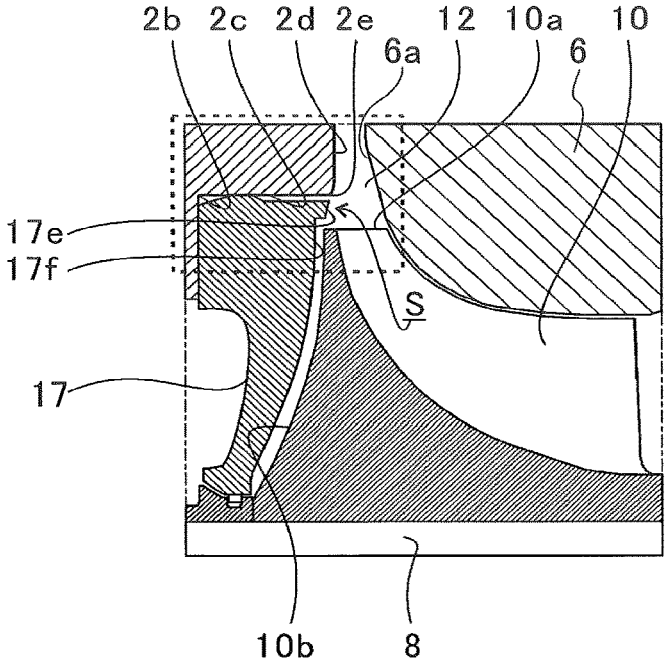
Figure 3B:
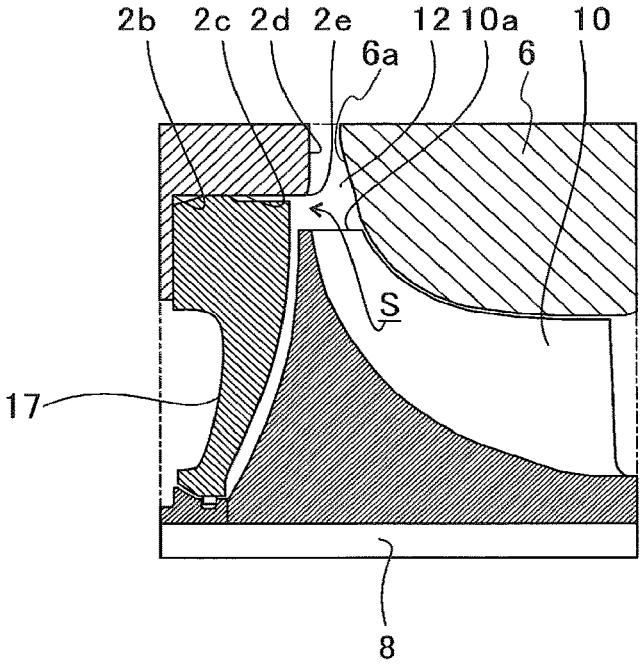

FIG. 3A and FIG. 3B are explanatory diagrams for explaining an action of the protrusion 17*e*. FIG. 3A is an enlarged diagram of a portion indicated with a chain dashed line in FIG. 1, and FIG. 3B shows a comparative example thereto.

As shown in FIG. 3B, the bearing housing 2 includes the opposed surface 2*d* which is opposed to the opposed surface 6*a* of the compressor housing 6 and forms the diffuser flow passage 12 in conjunction with the opposed surface 6*a*. The opposed surface 2*d* is located away by a gap S in the radial direction of the shaft 8 from a radially inside end 2*e* and from an outer peripheral edge 10*a* of the compressor wheel 10. In other words, an inner peripheral surface 2*c* that forms the fitting hole 2*b* of the bearing housing 2 is located away by the gap S in the radial direction of the shaft 8 from the outer peripheral edge 10*a* of the compressor wheel 10. That is to say, the gap S is formed between the radially inside end 2*e* (or the inner peripheral surface 2*c*) in the radial direction of the shaft 8 and the outer peripheral edge 10*a*.

In the meantime, the compressor wheel 10 keeps getting smaller and smaller. On the other hand, reduction in size of an outside diameter of the seal plate 17 is limited due to an issue of fixation strength to the bearing housing 2, and the like. Accordingly, the above-mentioned gap S tends to be increased. If the gap S is increased, stagnation of an air flow is apt to occur at the gap S portion, which contributes to turbulence of the air flow to the diffuser flow passage 12 side.

In this embodiment, as shown in FIG. 3A, the above-described protrusion 17*e* is located at the gap S. Specifically, the protrusion 17*e* is provided at a region of the seal plate 17 facing the gap S. The protrusion 17*e* extends more to the compressor housing 6 side than does any region 17*f* opposed to a back surface 10*b* of the compressor wheel 10. In other words, the protrusion 17*e* forms a step that protrudes from the region 17*f* to the compressor housing 6 side.

For this reason, according to the turbocharger C of this embodiment, the gap S can be made substantially smaller than that in the comparative example. In other words, a space on the outside in the radial direction viewed from the outer peripheral edge 10*a* of the compressor wheel 10 is filled with the protrusion 17*e*, whereby a distance is reduced between the outer peripheral edge 10*a* and a member located on the outside in the radial direction of the outer peripheral edge 10*a*. As a consequence, it is possible to suppress the turbulence of the flow of the fluid from the compressor wheel 10 toward the diffuser flow passage 12, and thus to improve compression efficiency.

Figure 4A:
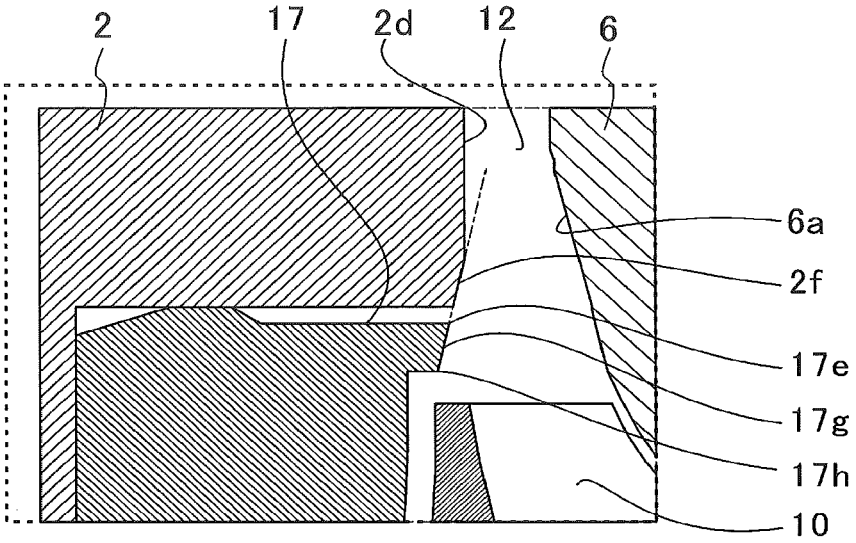
FIG. 4A and FIG. 4B are explanatory diagrams for explaining a shape of the protrusion in detail.
Figure 4B:
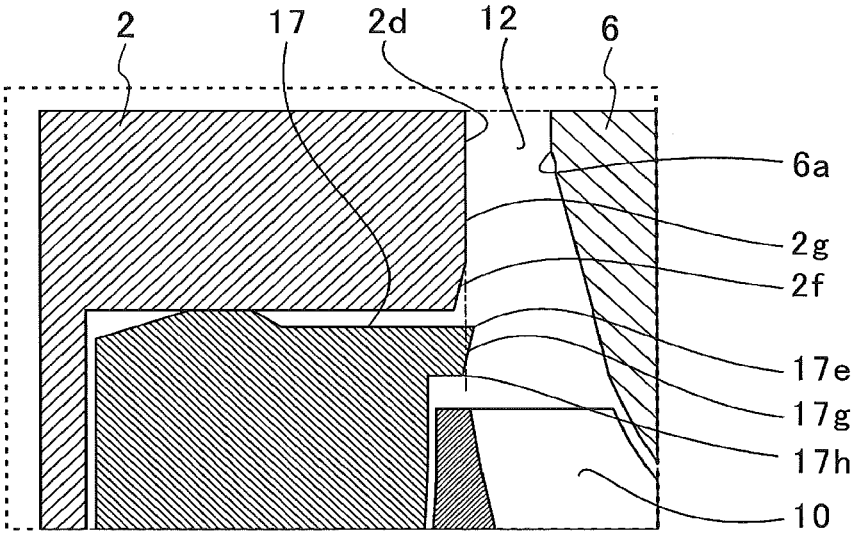

FIG. 4A and FIG. 4B are explanatory diagrams for explaining a shape of the protrusion 17*e* in detail. FIG. 4A is an enlarged diagram of a portion indicated with a dashed line in FIG. 3A, and FIG. 4B shows another example of a state of assembly regarding a cross section of the same region as that in FIG. 4A.

As shown in FIG. 4A, a tapered surface 2*f* is provided in a region of the bearing housing 2, which forms an inlet end on an upstream side (an end portion on the inside in the radial direction) of the diffuser flow passage 12. In other words, the tapered surface 2*f* is provided in a region of the opposed surface 2*d* of the bearing housing 2, which forms an inlet of the diffuser flow passage 12. The tapered surface 2*f* is inclined in such an orientation that the tapered surface 2*f* comes closer to the bearing 7 as the tapered surface 2*f* extends inward in the radial direction. Moreover, an inclined surface 17*g* is formed at a tip end of the protrusion 17*e* of the seal plate 17, i.e., in a region opposed to the compressor housing 6. The inclined surface 17*g* extends on an extended line (which is indicated with a chain dashed line in FIG. 4A) of the tapered surface 2*f* of the bearing housing 2. By locating the inclined surface 17*g* on the extended line of the tapered surface 2*f* of the bearing housing 2 as described above, it is possible to smoothly guide the air from the gap S to the diffuser flow passage 12 along the inclined surface 17*g* and the tapered surface 2*f*.

Note that there may be a case where a relative positional relation between the seal plate 17 and the bearing housing 2 is displaced by influences of dimensional tolerances of the respective members, a fitting engagement tolerance, and the like. For example, the protrusion 17*e* of the bearing housing 2 is assumed to protrude more to the compressor housing 6 side than a region 2*g* does as shown in FIG. 4B. Here, the region 2*g* is a region, which is of the opposed surface (a wall surface) 2*d* of the bearing housing 2 forming the diffuser flow passage 12, and is continuous from the tapered surface 2*f* to a downstream side (the outside in the radial direction) of the diffuser flow passage 12. In other words, the region 2*g* is a region of the opposed surface 2*d* being located on the downstream side of the diffuser flow passage 12 and including (or forming) a boundary with the tapered surface 2*f*.

A chain dashed line in FIG. 4B is an extended line of the region 2*g*. As shown in FIG. 4B, at least an end portion 17*h* is configured such that, even when the end portion 17*h* protrudes most to the compressor housing 6 side within a range of tolerance, the end portion 17*h* is still located on the bearing 7 side without protruding beyond the region 2*g* (the chain dashed line) of the bearing housing 2. Here, the end portion 17*h* is a portion at the tip end of the protrusion 17*e* of the seal plate 17, which is located on the innermost side in the radial direction.

For this reason, the air directed to the diffuser flow passage 12 flows substantially along the inclined surface 17*g* of the protrusion 17*e*. Accordingly, even when the relative positional relation between the seal plate 17 and the bearing housing 2 is displaced from the state shown in FIG. 4A, it is still possible to suppress the turbulence of the air flow from the compressor wheel 10 toward the diffuser flow passage 12.

Figure 5:
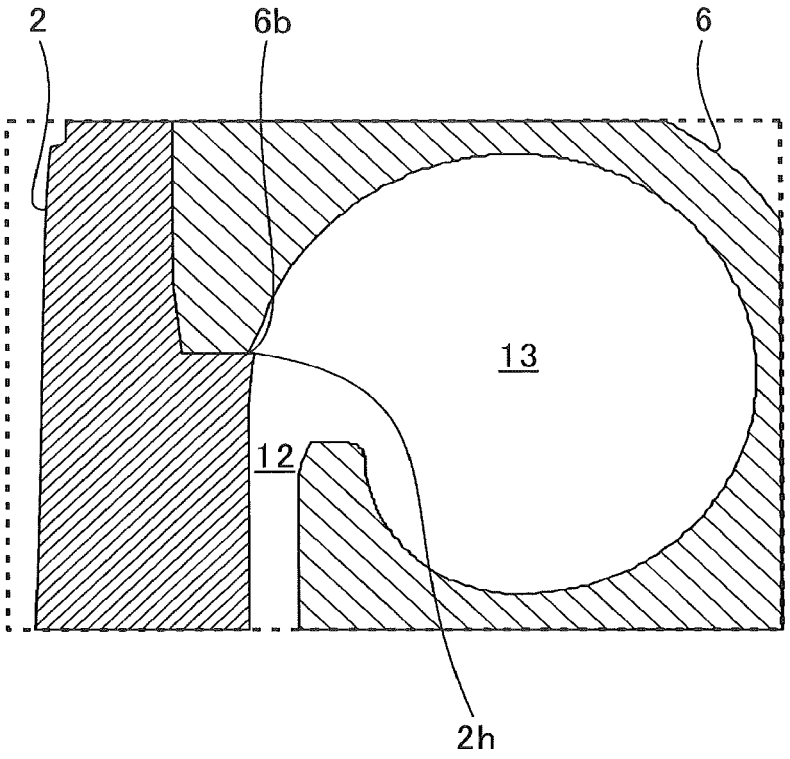
FIG. 5 is an enlarged diagram of a portion indicated with a dashed line in FIG. 1.

FIG. 5 is an enlarged diagram of a portion indicated with a dashed line in FIG. 1. As shown in FIG. 5, at a fitting engagement portion of the bearing housing 2 with the compressor housing 6, an end portion 2*h* of the bearing housing 2 protrudes to the diffuser flow passage 12 (the compressor scroll flow passage 13) side from an end portion 6*b* of the compressor housing 6.

Here, as with the above-described protrusion 17*e*, a relative positional relation is assumed to be displaced by influences of dimensional tolerances of members of the bearing housing 2 and the compressor housing 6, a fitting engagement tolerance, and the like. Hence, the bearing housing 2 constituting a wall surface on an upstream side of the air flow is caused to protrude more than does the compressor housing 6 in advance.

For this reason, even if the end portion 6*b* of the compressor housing 6 is displaced to the diffuser flow passage (the compressor scroll flow passage 13) side due to the dimensional tolerances, the fitting engagement tolerance, and the like, the air directed from the diffuser flow passage 12 to the compressor scroll flow passage 13 does not collide with the end portion 6*b* of the compressor housing 6, but instead flows substantially along the extension of the diffuser flow passage 12. Thus, it is possible to suppress the turbulence of the flow.

The above-mentioned embodiment has described the case in which the protrusion 17*e* is formed along the circumferential direction of the seal plate 17 except the portions overlapping the bolt holes 17*d*. However, the protrusion 17*e* may be formed over the entire circumference while the bolt holes 17*d* are formed inside of the protrusion 17*e* in the radial direction, for instance, or a width in the circumferential direction of the protrusion 17*e* may be made smaller instead.

Meanwhile, the above-mentioned embodiment has described the example of forming the protrusion 17*e* of the seal plate 17 as the extending portion that extends more to the compressor housing 6 side than does the region 17*f* opposed to the back surface 10*b* of the compressor wheel 10. However, the extending portion is not limited to the protrusion 17*e* having the shape as illustrated in FIG. 2A and FIG. 3A. For instance, the extending portion may be configured to include a tapered surface that is continuously formed from the region of the seal plate 17 opposed to the back surface 10*b* of the compressor wheel 10, and to extend more to the compressor housing 6 side than the region 17*f* does.

Meanwhile, the above-mentioned embodiment has described the case in which the inclined surface 17*g* has a linear shape as in the cross section shown in FIG. 4A. Instead, the inclined surface 17*g* may be bent into a curved shape.

Meanwhile, the above-mentioned embodiment has described the case in which the inclined surface 17*g* is provided to the protrusion 17*e*. However, the tip end of the protrusion 17*e* does not always have to be formed as the inclined surface 17*g*. Nevertheless, by providing the inclined surface 17*g*, even if the air flows into the gap S, the air can be smoothly guided from the gap S toward the diffuser flow passage 12 along the inclined surface 17*g*.

Meanwhile, the above-mentioned embodiment has described the case in which the bearing housing 2 (the opposed surface 2*d*) is provided with the tapered surface 2*f*. However, the tapered surface 2*f* may be omitted. In the meantime, the above-mentioned embodiment has described the case in which the inclined surface 17*g* extends on the extended line of the tapered surface 2*f*. However, the inclined surface 17*g* may be located in a position displaced from the extended line of the tapered surface 2*f*.

Meanwhile, the above-mentioned embodiment has described the case in which the end portion 17*h* on the inner side in the radial direction of the inclined surface 17*g* is offset to the bearing 7 side from the region 2*g* of the wall surface of the bearing housing 2 forming the diffuser flow passage 12, the region 2*g* being continuous from the tapered surface 2*f* to the outside in the radial direction. However, the tip end surface in the protruding direction of the protrusion 17*e* may be located flush with the region 2*g*, for example.

Alternatively, the seal plate 17 may not be provided with the inclined surface 17*g* while the bearing housing 2 may not be provided with the tapered surface 2*f*; and a flow passage surface (or a tangent line thereof) on the seal plate 17 side at a flow passage outlet end of the compressor wheel 10 may be formed parallel to the radial direction of the shaft 8, for example. In other words, the radially inside end 2*e* side of the opposed surface 2*d*, the tip end surface in the protruding direction of the protrusion 17*e*, and the flow passage surface on the seal plate 17 side at the flow passage outlet end of the compressor wheel 10 are located on a single straight line. In this way, it is possible to suppress the turbulence of the flow directed to the diffuser flow passage 12, and to guide the air smoothly.

Meanwhile, the above-mentioned embodiment has described the case in which the fastening bolts are the countersunk bolts. However, the fastening bolts are not limited to the countersunk bolts. Nevertheless, by using the countersunk bolts, it is possible to reduce a difference in level between the front surface 17*a* on the compressor wheel 10 side of the seal plate 17 and heads of the fastening bolts.

While the embodiment of the present disclosure has been described above with reference to the accompanying drawings, it is needless to say that the present disclosure is not limited only to this embodiment. It is obvious for a person skilled in the art that he or she can arrive at various changes or modifications within the scope as defined in the claims. It should be understood that such changes and modifications also naturally belong to the technical scope of the present disclosure.

What is claimed is:

1. A turbocharger comprising:

a bearing housing provided with a bearing hole;

a turbine shaft including a shaft rotatably supported by a bearing to be housed in the bearing hole, a turbine wheel provided on one end side of the shaft, and a compressor wheel provided on another end side of the shaft;

a compressor housing connected to the bearing housing and configured to house the compressor wheel in a housing space formed in the compressor housing;

a diffuser flow passage of an annular shape located outside of the compressor wheel in a radial direction, and formed by two opposed surfaces of the compressor housing and the bearing housing being opposed to each other; and a seal plate attached to the bearing housing, located inside of the diffuser flow passage in the radial direction, and disposed to be opposed to a back surface of the compressor wheel, wherein a gap in the radial direction is formed between a radially inside end of the opposed surface of the bearing housing forming the diffuser flow passage and an outer peripheral edge of the compressor wheel, the seal plate includes a region with a diameter larger than a diameter of the compressor wheel, the region of the seal plate is positioned at a same level as the gap in the radial direction, the region of the seal plate includes an extending portion extending from the region toward the gap along an axis of the turbine shaft, and the extending portion is positioned closer to a compressor housing side than any region of the seal plate opposed to the back surface of the compressor wheel.

2. The turbocharger according to claim 1, wherein, of the extending portion, a surface opposed to the compressor housing is an inclined surface that comes closer to the compressor housing as the inclined surface extends outward in the radial direction.

3. The turbocharger according to claim 2, wherein a tapered surface is provided in a region of the bearing housing, the region forming an end portion on an inside in the radial direction of the diffuser flow passage, the tapered surface being inclined in such an orientation that the tapered surface comes closer to a bearing side as the tapered surface extends inward in the radial direction, and the inclined surface extends on an extended line of the tapered surface.

4. The turbocharger according to claim 3, wherein an end portion on an inside in the radial direction of the inclined surface is located closer to the bearing side than a region of a wall surface of the bearing housing forming the diffuser flow passage, the region being continuous from the tapered surface to an outside in the radial direction.

5. The turbocharger according to claim 2, wherein a radially outer end of the inclined surface is closer to the compressor housing than the surface of the bearing housing forming the diffuser flow passage.

* * * * *